US010640258B2

(12) United States Patent
Bjurenheim et al.

(10) Patent No.: US 10,640,258 B2
(45) Date of Patent: May 5, 2020

(54) PACKAGE COMPRISING A DRINKING DEVICE RESTRICTED TO MOVE IN A PRE-DETERMINED PLANE

(71) Applicant: Tetra Laval Holdings & Finance S.A., Pully (CH)

(72) Inventors: Joachim Bjurenheim, Rubiera (IT); Göran Dahl, Höör (SE); Gustav Levander, Staffanstorp (SE); Mario Tronza, Basel (CH); Antonino Lanci, Bern (CH); Elmar Mock, Salvan (CH)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/083,233

(22) PCT Filed: Mar. 6, 2017

(86) PCT No.: PCT/EP2017/055195
§ 371 (c)(1),
(2) Date: Sep. 7, 2018

(87) PCT Pub. No.: WO2017/153340
PCT Pub. Date: Sep. 14, 2017

(65) Prior Publication Data

US 2019/0100348 A1 Apr. 4, 2019

(30) Foreign Application Priority Data

Mar. 10, 2016 (SE) ..... 1650322

(51) Int. Cl.
*B65D 5/74* (2006.01)
*B65D 77/28* (2006.01)

(52) U.S. Cl.
CPC ..... *B65D 5/748* (2013.01); *B65D 77/28* (2013.01)

(58) Field of Classification Search
CPC ..... B65D 5/748; B65D 77/28; B65D 77/283; B65D 77/286; B65D 2517/0049; A47G 21/18; A47G 21/186
(Continued)

(56) References Cited

U.S. PATENT DOCUMENTS 2,617,559 A 11/1952 Van Der Spek
3,486,679 A * 12/1969 Pfahler ..... B65D 77/283 229/103.1
(Continued)

FOREIGN PATENT DOCUMENTS

DE 4214107 A1 11/1993
EP 0053305 A1 6/1982
(Continued)

OTHER PUBLICATIONS

Search Report and Written Opinion received for International Application No. PCT/EP2017/055195 dated Jun. 12, 2017 in 11 pages.
(Continued)

*Primary Examiner* — Christopher R Demeree
(74) *Attorney, Agent, or Firm* — Knobbe, Martens, Olson & Bear, LLP

(57) ABSTRACT

The present disclosure relates to a package for a liquid food product, the package comprising a container and a hollow body for transporting the liquid food product from the container. The hollow body comprises a first part fixedly attached to a first section of the container and a second part releasably attached to a second section of the container, such that when the second part is released from the second section the second part is pivotable around an intersection point between the first part and the second part. Further, the present disclosure includes methods for producing a package
(Continued)

comprising a container and a hollow body, and for producing a hollow body arranged to be attached to a container.

20 Claims, 9 Drawing Sheets

(58) Field of Classification Search
USPC ..... 229/103.1, 204, 140; 220/710, 707, 708; 215/388, 229, 389; 206/217; 222/335, 222/83; 383/906
See application file for complete search history.

(56) References Cited

U.S. PATENT DOCUMENTS

| | | | | |
|---|---|---|---|---|
| 4,858,766 | A * | 8/1989 | Tsai | B65D 5/705 229/204 |
| 5,054,631 | A | 10/1991 | Robbins, III | |
| 5,188,283 | A | 2/1993 | Gu | |
| 5,353,983 | A * | 10/1994 | Miller | B65D 25/42 215/389 |
| 5,495,982 | A | 3/1996 | Wang | |
| 6,227,403 | B1 | 5/2001 | Kim | |
| 6,321,977 | B1 | 11/2001 | Lee | |
| 6,431,434 | B1 * | 8/2002 | Haughton | B65B 61/205 220/708 |
| 6,648,217 | B2 * | 11/2003 | Schein | B65D 77/12 229/103.1 |
| 6,745,949 | B2 * | 6/2004 | Lee | A47G 21/18 215/229 |
| 7,392,916 | B1 * | 7/2008 | Kuighadush | B65D 77/283 220/707 |
| 8,851,324 | B2 * | 10/2014 | O'Sullivan | A47G 19/2266 220/710 |
| 8,939,349 | B2 * | 1/2015 | Lerner | A47G 19/2266 206/217 |
| 10,377,550 | B1 * | 8/2019 | Tseng | A47G 19/2266 |
| 2002/0170930 | A1 | 11/2002 | Elder | |
| 2005/0260304 | A1 | 11/2005 | Schaffer et al. | |

FOREIGN PATENT DOCUMENTS

| | | | |
|---|---|---|---|
| JP | H08282710 | A | 10/1996 |
| JP | H11236074 | A | 8/1999 |
| JP | 2001072046 | A | 3/2001 |
| KR | 100870696 | B1 | 11/2008 |
| KR | 20080096738 | A | 11/2008 |
| KR | 20100008128 | A | 1/2010 |
| KR | 2010/0094285 | A | 8/2010 |
| KR | 20110023338 | A | 3/2011 |
| KR | 2012/0000695 | U | 2/2012 |
| LU | 90268 | A1 | 2/2000 |
| WO | WO 2010/062247 | A1 | 6/2010 |

OTHER PUBLICATIONS

Search Report and Written Opinion received in International Application No. PCT/EP2017/055199 dated Jun. 1, 2017 in 9 pages.
Office Action and Search Report received for Swedish Application No. 1650322-9 dated Nov. 10, 2016 in 14 pages.
Search Report and Office Action received in Swedish Application No. 1650325-2 dated Nov. 10, 2016 in 13 pages.
Office Action received in U.S. Appl. No. 16/083,331, dated Oct. 22, 2019, in 10 pages.

* cited by examiner

PACKAGE COMPRISING A DRINKING DEVICE RESTRICTED TO MOVE IN A PRE-DETERMINED PLANE

TECHNICAL FIELD

The present inventive concept relates to the field of packaging. More particularly, there are disclosed packages with improved features, and related methods and devices.

BACKGROUND

Many packages for beverages are manufactured in so-called portion volumes, intended to be consumed straight from the package. The majority of these packages are provided as an assembly with a drinking straw in a protective envelope which is secured on the one side wall of the package. The packages, which may have parallelepipedic or tetrahedral configuration, are manufactured from a laminate with a core of paper or paperboard, with different layers of thermoplastics and possibly aluminum foil. On the one wall of the package, most often the upper or top wall, a hole has been punched out in the core layer and this hole is covered by the remaining layers of the laminate. This makes it possible to penetrate the hole with the drinking straw which accompanies the package, resulting in a drinking straw with direct access to the drink enclosed in the package.

A problem with assemblies as described above is that it is difficult to consume the beverage on-the-go. Preparation of the package before consumption is needed, and comprises several steps; removing the protective envelope enclosing the drinking straw from the package, after which the protective envelope is opened to retrieve the drinking straw; inserting the drinking straw into the package; adjusting an end section of the drinking straw to direct the drinking straw into the mouth of the user intending to imbibe the drink. In addition, several of the above mentioned steps require two hands; alternatively, in some steps, a consumer may use one hand in combination with his or her teeth. Further, contaminants from the consumer risk entering the package. Further, the insertion of the drinking straw sometimes requires extensive force, causing contents to spill out of the package. Further, the protective envelope has to be discarded by the user.

Another problem is that the drinking straw may be separated from the package during production or transport, thus forcing the package, including the drink enclosed, to be discarded. Even worse, the problem of the missing drinking straw may not be discovered until the consumer intends to open the package.

SUMMARY OF THE INVENTION

It is an object of the present inventive concept to mitigate, alleviate, or eliminate one or more of the above-identified deficiencies in the art and disadvantages singly or in combination.

According to a first aspect of the inventive concept, these and other objects are achieved in full, or at least in part, by a package for a liquid food product. The package comprises a container and a hollow body for transporting the liquid food product from the container. The hollow body comprises a first part fixedly attached to a first section of the container and a second part releasably attached to a second section of the container, such that when the second part is released from the second section the second part is pivotable around one axis of rotation in an intersection point between the first part and the second part providing for that said second part is restricted to move in a pre-determined plane.

Hereby, on-the-go consumption is simplified. Further, the risk of the hollow body detaching from the container during transport is decreased.

The hollow body may further comprise a third part arranged between the first part and the second part.

The third part may be crimped.

Hereby, bending of the hollow body is facilitated.

The second section may be a top section of the container.

The hollow body may further comprise a first piece and a second piece, wherein at least a portion of a periphery of the first piece is attached to at least a portion of a periphery of the second piece, forming an attachment portion, in order to form the hollow body.

The attachment portion may restrict the second part to be moved in the pre-determined plane.

At least one of the first piece and the second piece may comprise at least one spacing element providing for that a flow channel inside the hollow body is kept open.

The first piece may comprise a first material being a polymeric material, preferably a thermoplastic, preferably selected from the group consisting of PET, PE, PP, and PS.

The second piece may comprise a second material being a polymeric material, preferably a thermoplastic, preferably selected from the group consisting of PET, PE, PP, and PS.

The second part may be at least partially covered by a protective element such that an end section of the second part is prevented from being contaminated.

The protective element may be attached to the container.

According to a second aspect of the inventive concept, these and other objects are achieved in full, or at least in part, by a method for producing a package comprising a container and a hollow body, wherein the method comprises attaching a first part of the hollow body to a first section of the container, such that the first part is fixedly attached to the first section; and attaching a second part of the hollow body to a second section of the container, such that the second part is releasably attached to the second section.

The method may further comprise aligning the hollow body with a weakened portion of the container.

The step of aligning the hollow body with the weakened portion of the container may be made using at least one mark on the container.

According to a third aspect of the inventive concept, these and other objects are achieved in full, or at least in part, by a method for producing a hollow body arranged to be attached to a container, wherein the method comprises attaching a first piece made of a first material to a second piece made of a second material.

The method may further comprise attaching at least a portion of a periphery of the first piece to at least a portion of a periphery of the second piece, forming an attachment portion, in order to form the hollow body.

Other objectives, features and advantages of the present invention will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention/inventive concept, will be better understood through the following illustrative and non-limiting detailed description of different embodiments of the present invention/inventive concept, with reference to the appended drawings, wherein.

DETAILED DESCRIPTION

Figure 1:
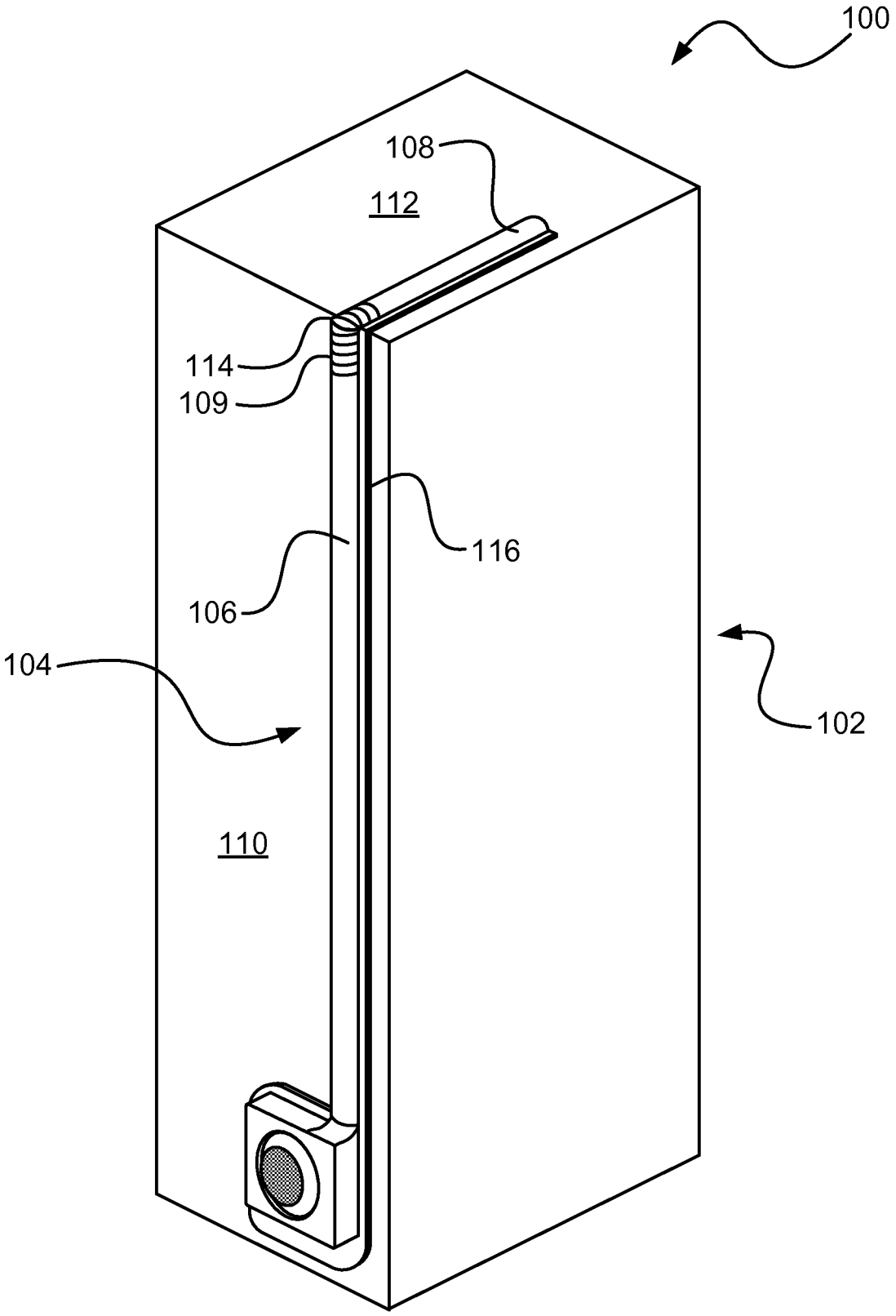
FIG. 1 illustrates a package comprising a container and a drinking device.

FIG. 1 illustrates a package 100 comprising a container 102 and a drinking device. The container 102 may be a carton-based container. The container 102 may have a default shape. The container 102 may be designed to change its shape as a result of a difference between an external pressure and an internal pressure. The external pressure may be a pressure exerted by the weight of the Earth's atmosphere, and/or a pressure exerted by the force of a consumer's hand gripping the container 102. The internal pressure is defined as a pressure in an inner space of the container 102. The container 102 may strive towards returning to its default shape. The container 102 may comprise creases such that a change of shape of the container 102 due to the difference between the external pressure and the internal pressure can be controlled. Here, the drinking device can be described as a hollow body 104 comprising a first part 106 fixedly attached to a first section 110 of the container 102, and a second part 108 releasably attached to a second section 112 of the container 102, such that when the second part 108 is released from the second section 112 the second part is pivotable around an intersection point 114 between the first part 106 and the second part 108. It is to be understood that the first part 106 is fixedly attached so as to be firm and not readily movable. A first sub-area of the first part may be adhered to the first section. A second sub-area of the second part may be adhered to the second section. The first sub-area may be larger than the second sub-area, such that the first part is fixedly attached to the first section and the second part is releasably attached to the second section. The first section 110 may be located on a side wall of the container 102. The second section 112 may be located on any surface of the container 102. The hollow body 104 may comprise a first piece and a second piece, wherein at least a portion of a periphery of the first piece is attached to at least a portion of a periphery of the second piece, forming an attachment portion 114, in order to form the hollow body. The attachment portion may restrict the second part to be moved in a pre-determined plane. The pre-determined plane may be aligned with a longitudinal axis of the hollow body. A transverse cross-section of the hollow body 104 may be in the shape of a semi-ellipse, such that the second part 108 of the hollow body 104 is restricted to be pivotable around the intersection point 114 and around a major axis of the semi-ellipse. The first part 106 may comprise a first transverse cross-section in the shape of a semi-ellipse comprising a first minor axis and a first major axis, wherein the first major axis may extend substantially along the first section 110 of the container 102. The second part 108 may comprise a second transverse cross-section in the shape of a semi-ellipse comprising a second minor axis and a second major axis, wherein the second major axis may extend substantially along the second section 112 of the container 102. The hollow body 104 may comprise a third part 109 arranged between the first part 106 and the second part 108. The third part 109 may be crimped. The third part 109 may comprise a third transverse cross-section in the shape of a semi-ellipse comprising a third minor axis extending outwards from the container 102, wherein the third minor axis may be shorter than the first and second minor axes. The third minor axis may be equal in length compared to the first and second minor axes.

Figure 2:
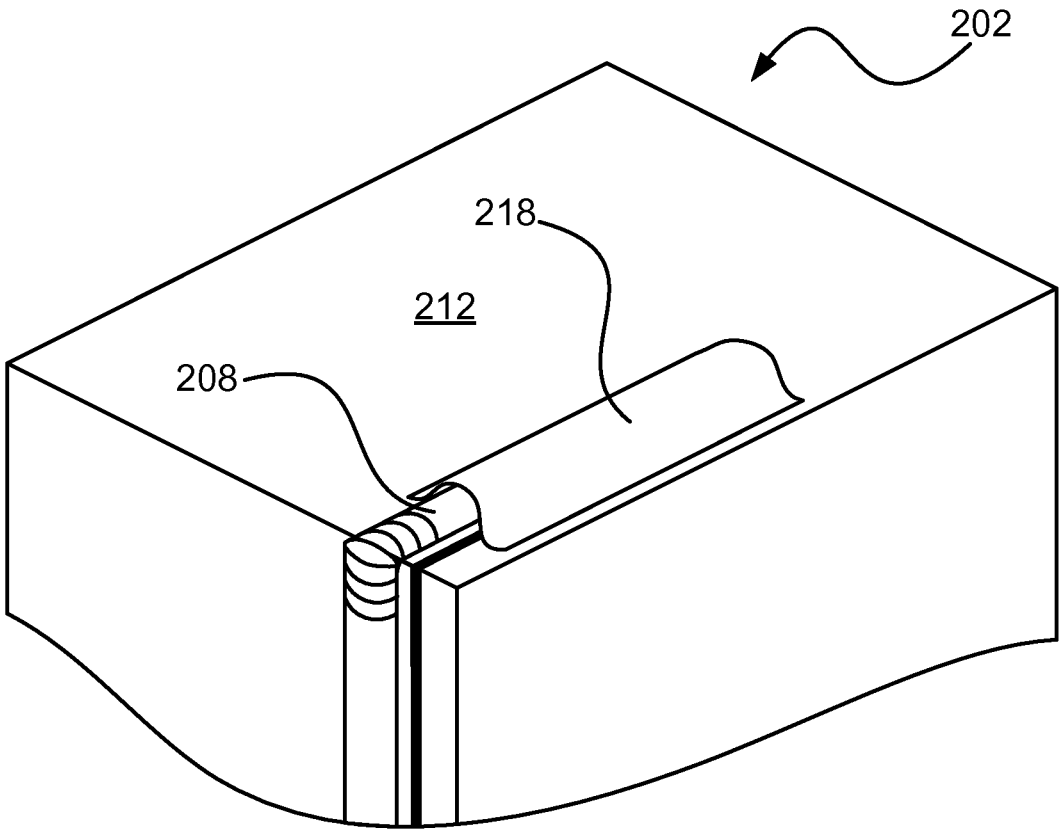
FIG. 2 illustrates a partial sectional view of a protective element covering a drinking device.

FIG. 2 illustrates a package similar to the one shown in FIG. 1; a protective element 218 may cover a second part 208 of a hollow body such that an end section of the second part 208 is prevented from being contaminated. The protective element 218 may be attached to a container 202. The second part 208 may be indirectly secured to a second section 212 of the container 202 by the protective element 218, and/or directly secured to the second section 212 by an adhesive, such as glue. The protective element 218 may be perforated to facilitate removal from the second part 208. After removal from the second part 208, the protective element 218 may be retained by the container 202.

Figure 3A:
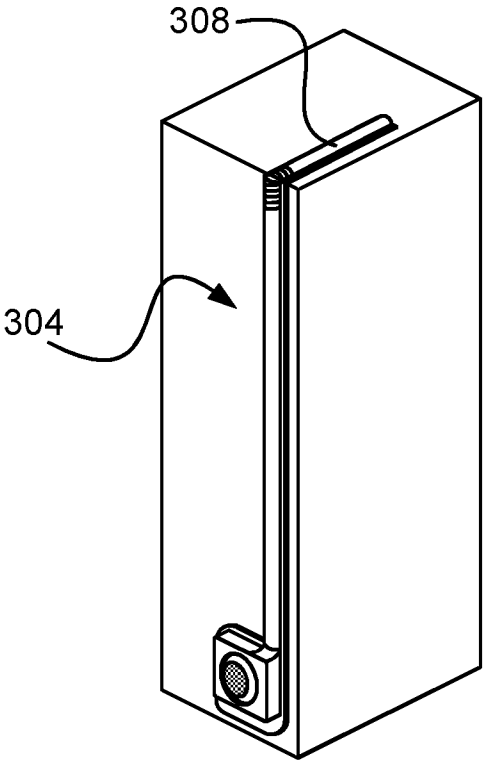
FIGS. 3*a*-3*c* illustrate an opening process of a package comprising a container and a drinking device.
Figure 3B:
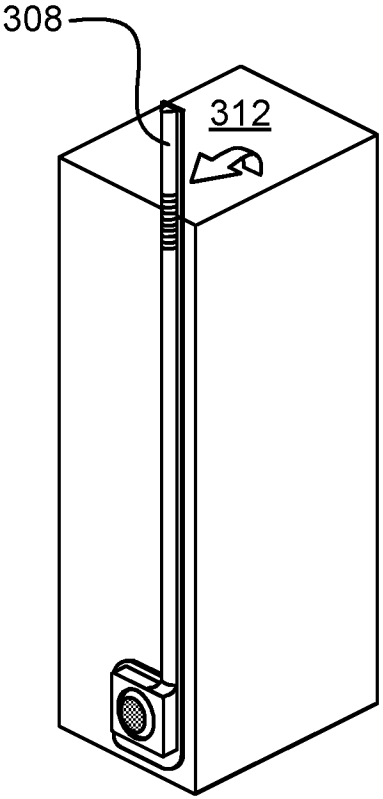
Figure 3C:
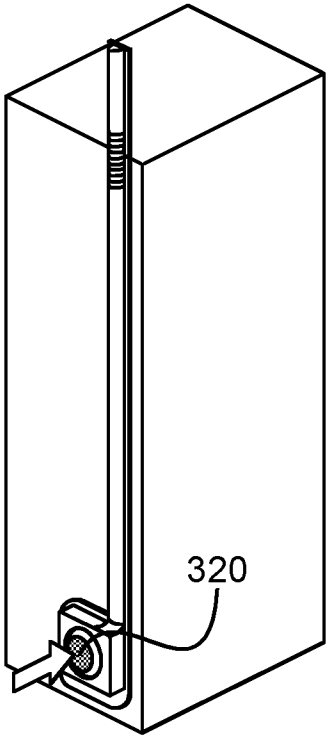

Referring now to FIG. 3*a*-3*c*, a package may be prepared for drinking by removing a protective element (not shown), releasing a second part 308 of a hollow body 304 releasably attached to a second section 312 of a container, and pushing a flexible portion 320 of at least one of a first piece and a second piece of the hollow body 304 such that a cutting member is indirectly pushed through a weakened portion of the container such that liquid held in the container can be transferred out from the container via the hollow body 304. By indirectly pushing the cutting member, contaminants may be prevented from entering the container.

Figure 4:
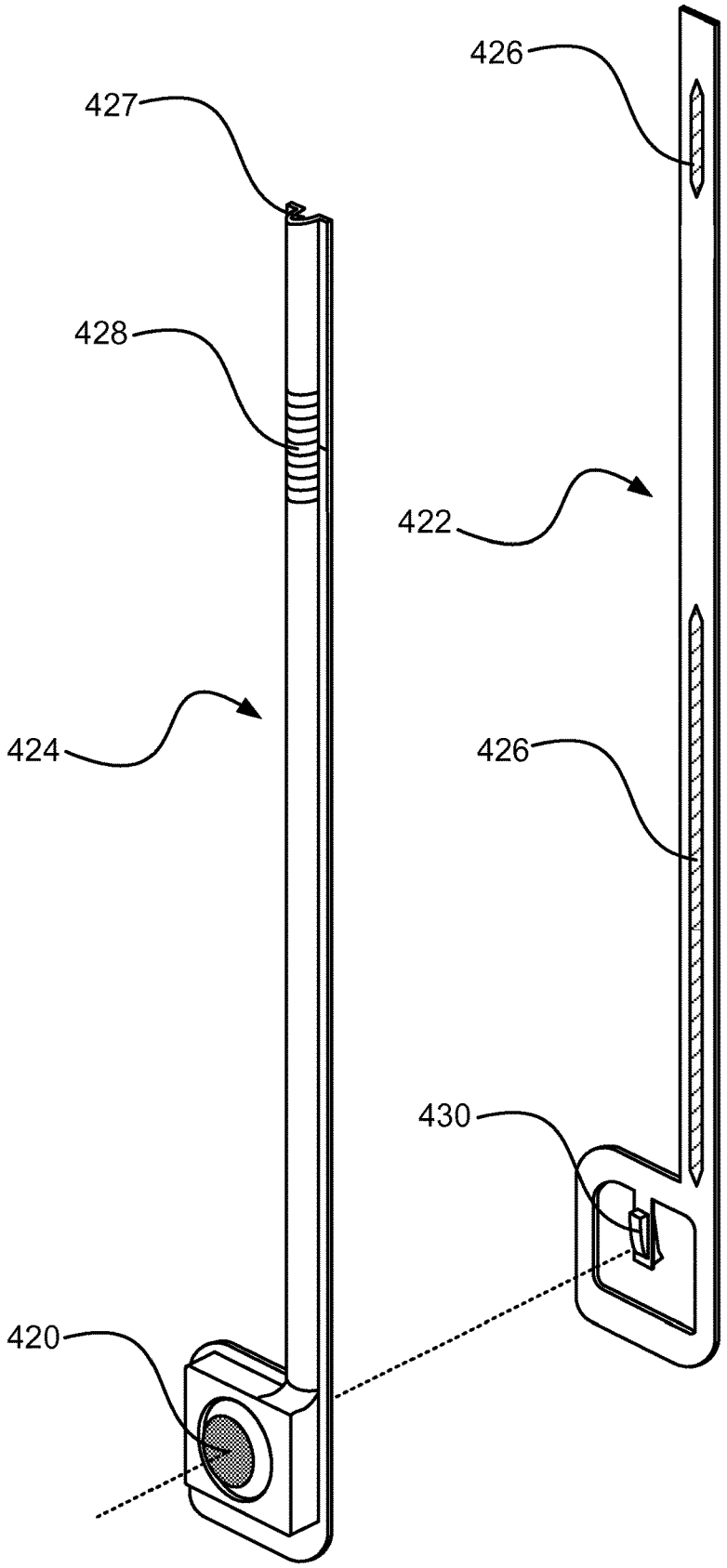
FIG. 4 illustrates an exploded view of a hollow body.

Referring now to FIG. 4, a hollow body may comprise a first piece 422 and a second piece 424, wherein at least a portion of a periphery of the first piece 422 is attached to at least a portion of a periphery of the second piece 424, forming an attachment portion, in order to form the hollow body. The first piece 422 may comprise a flat bottom to provide for that a contact area between the first piece 422 and a first section and/or a second section of a container is maximized, thereby facilitating attachment of the first part to the first section and/or second section of the container. At least one of the first piece 422 and second piece 424 may comprise at least one spacing element 426 providing for that a flow channel inside the hollow body is open. The at least one spacing element 426 may extend along a longitudinal axis of the hollow body. At least one of the first piece 422 and the second piece 424 may comprise a crimped portion 428. At least one of the first piece 422 and the second piece 424 may comprise a cutting member 430 arranged at a weakened portion of a container such that a hole can be made in the container with the cutting member 430. At least one of the first piece 422 and the second piece 424 may comprise a flexible portion 420 aligned with the cutting member 430 such that when the flexible portion 420 is pushed towards the container the cutting member 430 is indirectly pushed through the weakened portion. Here, the first piece 422 comprises the cutting member 430, and the second piece 424 comprises the flexible portion 420. It is to be understood that any one of the first piece 422 and the second piece 424 may comprise the flexible portion 420 and/or the cutting member 430, as long as the flexible portion 420 is aligned with the cutting member 430 such that when the flexible portion 420 is pushed towards the container the cutting member 430 is indirectly pushed through the weakened portion. The cutting member 430 may be separate from the first piece 422 and the second piece 424. The weakened portion may be enclosed by part of a container side and at least one of the first piece 422 and the second piece 424, such that liquid held in the container can be transferred out from the container via the hollow body. At least one of the first piece 422 and the second piece 424 may be arranged to create a seal around the weakened portion, such that vent air is prevented from flowing into the container as liquid is dispensed through the hollow body, and such that fluid flow through the hollow body commences when a pressure differential is applied across the fluid outlet and an inner space of the container. As a result of the seal, a slight sub-atmospheric pressure may develop within the container during drinking from the container via the hollow body, such that liquid in the hollow body may be forced back into the container as soon as a consumer removes the hollow body from his or her mouth. The user may remove his or her mouth from the fluid outlet, allowing air to vent through the hollow body into the container such that any pressure differential within the container may be eliminated. Tipping or inverting the container may cause liquid held in the container to begin flowing through the hollow body as a result of a pressure applied by the weight of the liquid. Liquid flowing through the hollow body as a result of a pressure applied by the weight of the liquid may be prevented from reaching the fluid outlet of the hollow body by choosing an appropriate length of the hollow body, such that a sufficient sub-atmospheric pressure may develop within the container, such that the pressure applied by the weight of the liquid may be overcome, such that the liquid may stop flowing through the hollow body.

Still referring to FIG. 4, the container may be ductile, and/or comprise flexible material and/or a particularly thin wall thickness, such that any substantial sub-atmospheric pressure within the container may tend to temporarily buckle the body wall of the container. The first piece 422 may comprise a first material, wherein the first material is a polymeric material, e.g. a thermoplastic, for example selected from the group consisting of polyethylene terephthalate (PET), polypropene (PP), polyethylene (PE), and polystyrene (PS). The second piece 424 may comprise a second material, wherein the second material is a polymeric material, e.g. a thermoplastic selected from the group consisting of PET, PP, PE, and PS. The first piece 422 may be harder and/or stiffer than the second piece 424. The first piece 422 and/or the second piece 424 may be transparent. The first piece 422 and/or the second piece 424 may be provided with a color. The transparency and/or color of the first piece 422 and/or the second piece 424 may be chosen such that a sufficiently high contrast between the liquid and the hollow body is obtained such that a liquid level of the hollow body can be determined by visual inspection. The possibility of providing different colors to the first piece and/or second piece, and/or having at least one of the first piece and second piece transparent, enables an increased level of customization of the package compared to today's packages.

In an alternative embodiment not depicted, a hollow body may comprise a first piece and a second piece, wherein the first piece comprises a cutting member and a flexible portion for indirectly pushing the cutting member through a weakened portion of a container, and wherein the second piece comprises an elongated tube. At least a portion of a periphery of the first piece may be attached to at least a portion of a periphery of the second piece, in order to form the hollow body.

Figure 5:
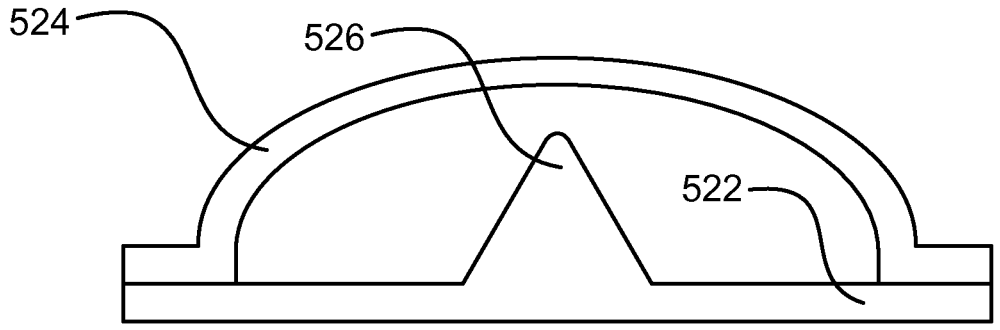
FIG. 5 illustrates a cross-sectional view of a hollow body.

Referring now to FIG. 5, a hollow body may comprise a first piece 522 and a second piece 524. At least one of the first piece 522 and the second piece 524 may comprise at least one spacing element 526. The at least one spacing element 526 may be in contact with at least one of the first piece 522 and the second piece 524. The at least one spacing element 526 may be of any geometrical shape such that a flow channel inside the hollow body is open, e.g. semi-elliptical, triangular, rectangular, circular, cylindrical.

Figure 6:
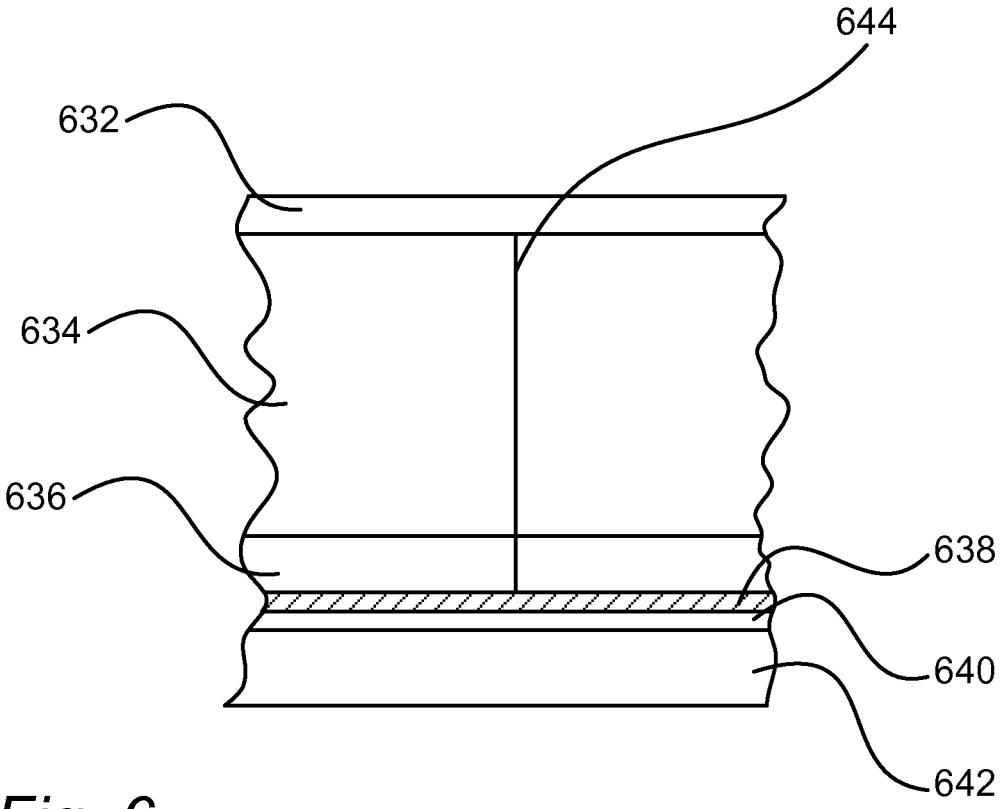
FIG. 6 illustrates a cross-sectional view of a weakened portion of a container.

Referring now to FIG. 6, a carton based container generally comprises several layers; an outer coating 632, a paper hoard layer 634, a lamination 636, an aluminum layer 638, a first internal coating 640, and a second internal coating 642. Here, a weakened portion 644 of the container is made by a cut through the paper hoard layer 634 and lamination 636. The weakened portion 644 may be provided by laser cutting.

Figure 7:
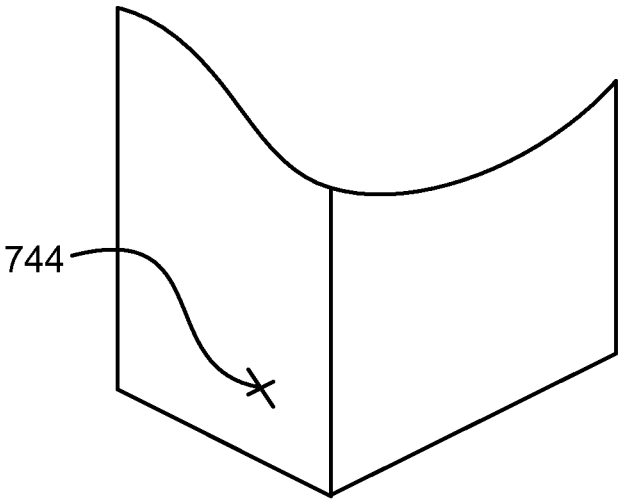
FIG. 7 illustrates a partial sectional view of a weakened portion of a container.

Referring now to FIG. 7, a weakened portion 744 may be located on any side of a container. The weakened portion 744 may be located on a front section, a bottom section, or a side section of a container. The weakened portion 744 may comprise at least one cut of at least one of several layers forming a wall of a container. The weakened portion 744 may comprise several cuts of at least one of several layers forming a wall of a container, wherein the several cuts may overlap. The weakened portion 744 may be located in a lower half of the container when the container is in an upright position. The weakened portion 744 may be located such that a liquid level of a full container is above the weakened portion when the container is in an upright position. The weakened portion 744 may be located such that a liquid level of a container is above or in line with the weakened portion when the container is in an upright position.

Figure 8:
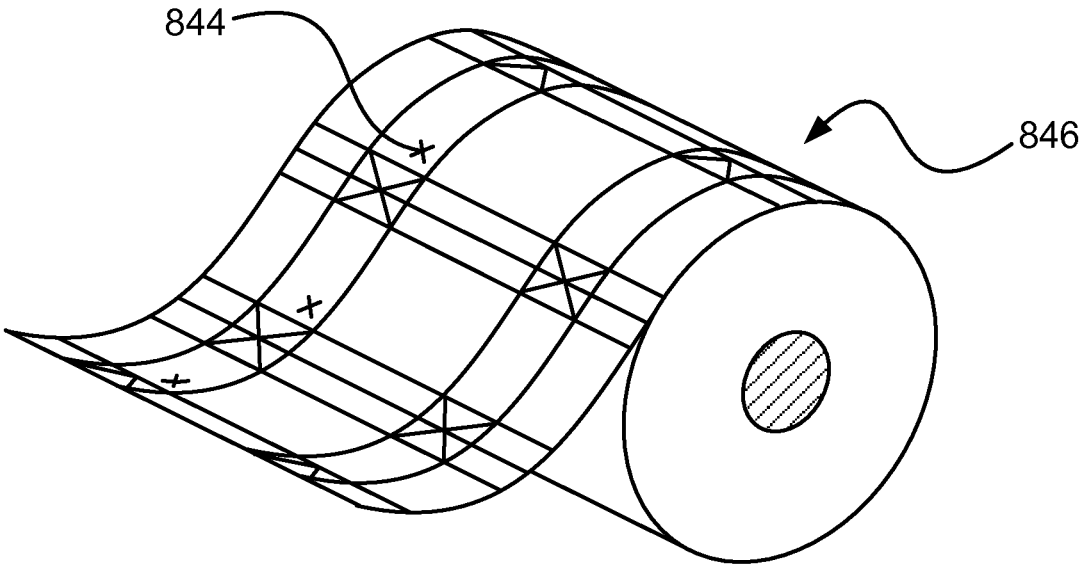
FIG. 8 illustrates a reel of packaging material.

Referring now to FIG. 8, a reel 846 of packaging material may comprise weakened portions 844 as shown in FIGS. 6-7. The reel 846 may be used in a filling machine to produce filled packages.

Figure 9A:
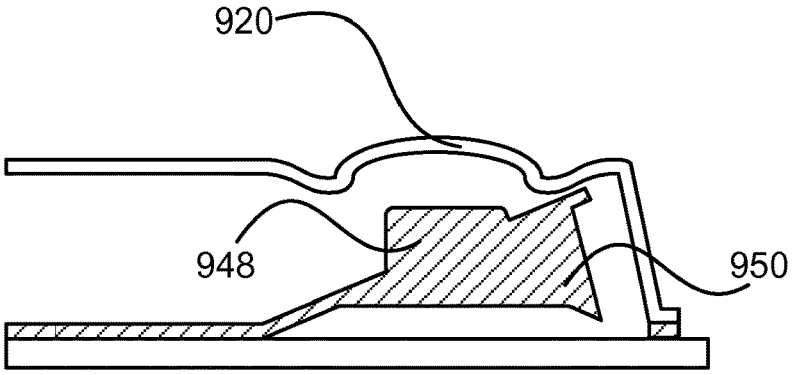
FIGS. 9*a*-9*c* illustrate three stages of a cutting member being pushed through a container.
Figure 9B:
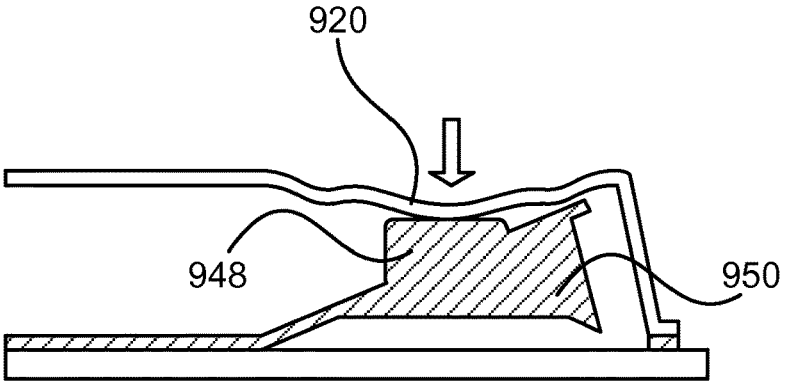
Figure 9C:
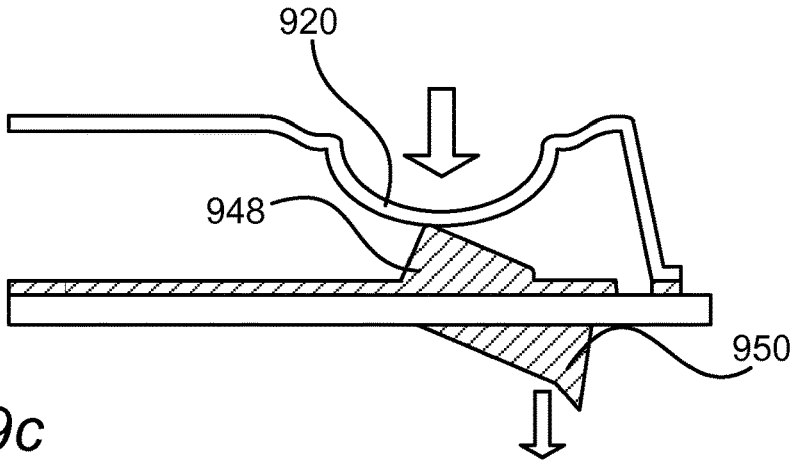

Referring now to FIGS. 9*a*-9*c*, a package may be opened by pushing a flexible portion 920 such that a cutting member is indirectly pushed through a weakened portion of a container. In a first step of an opening process, the flexible portion 920 may be pushed until contact with an upper part 948 of a cutting member. In a second step of an opening process, the flexible portion 920 may be pushed against the upper part 948 of the cutting member with enough force such that a cutting part 950 of the cutting member penetrates the weakened portion at the container. The flexible portion 920 may be in the shape of a hemisphere. The flexible portion 920 may protrude in a direction substantially perpendicular to a longitudinal axis of the hollow body and/or in a direction substantially orthogonal to the first side to which the first part of the hollow body is attached. The flexible portion 920 may be encircled by a groove, such that flexing of the flexible portion is facilitated.

Figure 10:
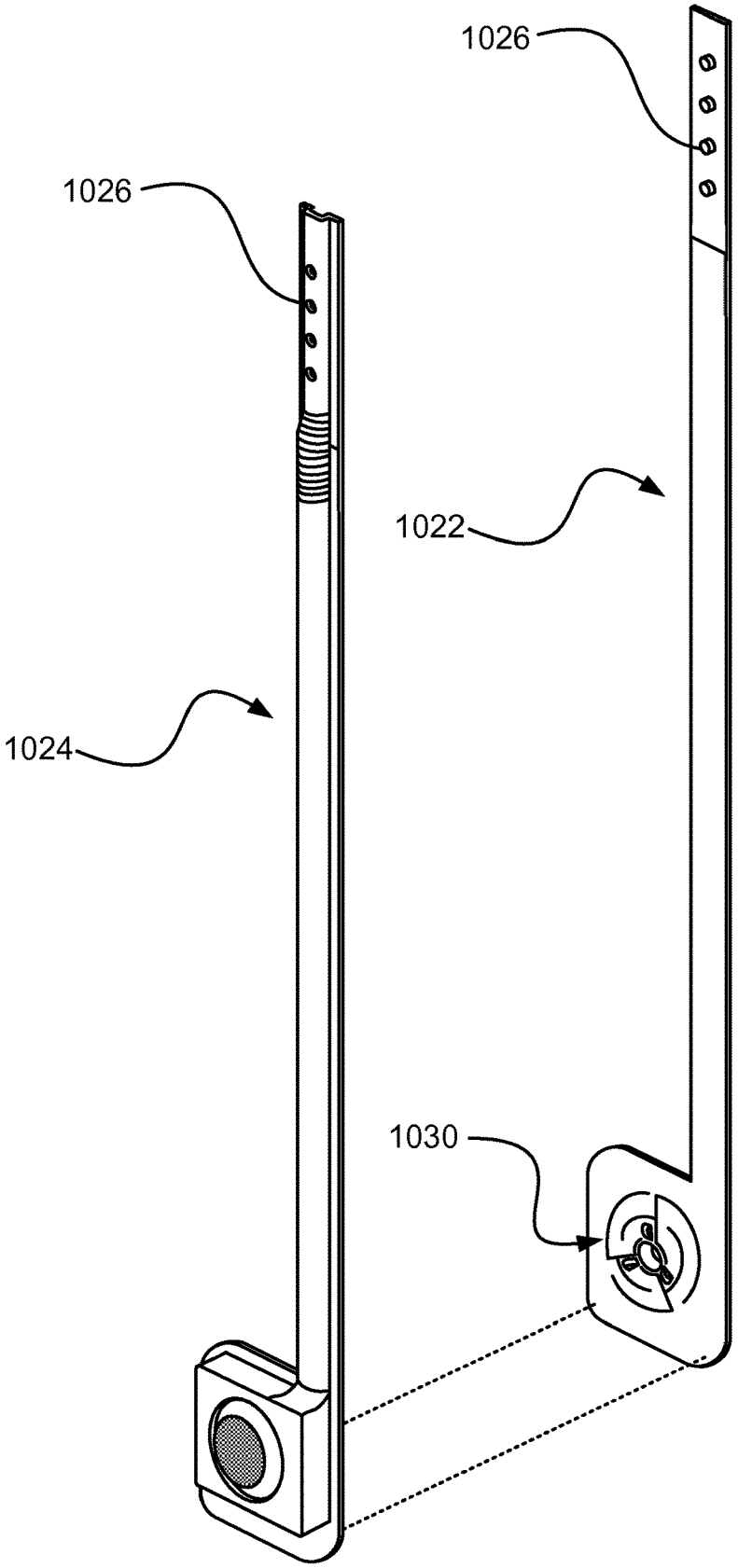
FIG. 10 illustrates an exploded view of an alternative embodiment of a hollow body.
Figure 11A:
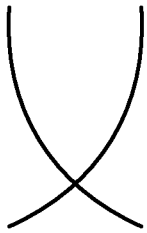
FIGS. 11*a*-11*d* illustrate different shapes of a weakened portion of a container.
Figure 11B:
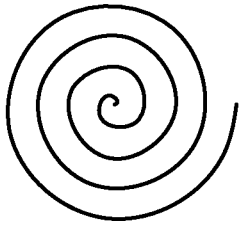
Figure 11C:
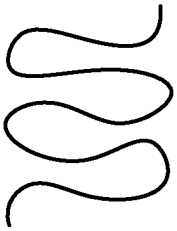
Figure 11D:
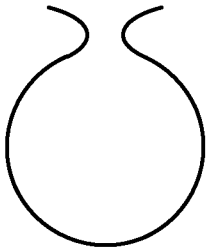

Referring now to FIG. 10, an alternative embodiment of a hollow body may comprise a first piece 1022 and a second piece 1024, wherein at least a portion of a periphery of the first piece 1022 is attached to at least a portion of a periphery of the second piece 1024, forming an attachment portion, in order to form the hollow body. The first piece 1022 may comprise a flat bottom to provide for that a contact area between the first piece 1022 and a first section and/or a second section of a container is maximized, thereby facilitating attachment of the first part to the first section and/or second section of the container. At least one of the first piece 1022 and second piece 1024 may comprise at least one spacing element 1026 providing for that a flow channel inside the hollow body is open. The at least one spacing element 1026 may extend along a longitudinal axis of the hollow body. Here, both the first piece 1022 and the second piece 1024 comprise spacing elements. At least one of the first piece 1022 and the second piece 1024 may comprise a crimped portion. At least one of the first piece 1022 and the second piece 1024 may comprise a cutting member 1030 arranged at a weakened portion of a container such that a hole can be made in the container with the cutting member 1030. It is to be understood that the hollow body depicted in FIG. 10 generally operates in a similar way to the hollow body described in FIG. 4 to provide a similar function. Further, the features of the hollow body depicted in FIG. 10 may be applied to the hollow body described in FIG. 4, and vice versa.

Referring now to FIGS. 11*a*-11*d*, different weakened portions are depicted in a top view. It is to be understood that the illustrations only serve to depict a general shape of the weakened portion, and may not be drawn to scale. The weakened portion may be in the shape of a bow. The weakened portion may be in the shape of a spiral. The weakened portion may be in the shape of a serpentine. The weakened portion may be in the shape of an open-ended circle.

Figure 12:
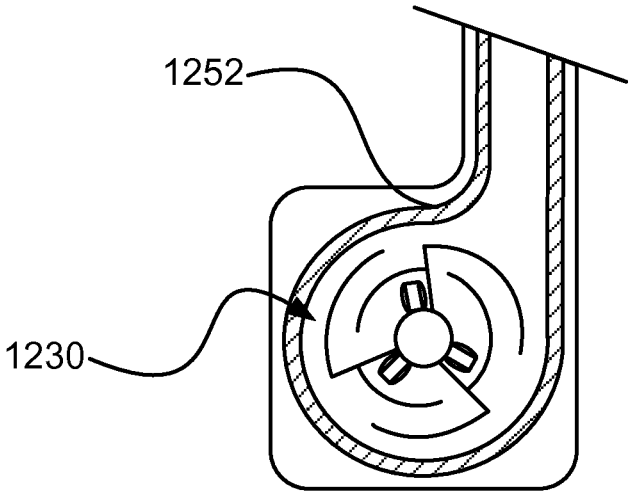
FIG. 12 illustrate a top view of a first piece of a hollow body.

Referring now to FIG. 12, an alternative embodiment of a cutting member 1230 is depicted in a top view. A first piece of a hollow body may comprise a ridge 1252. The ridge 1252 may enclose the cutting member 1230.

The invention has mainly been described above with reference to a few embodiments. However, as is readily appreciated by a person skilled in the art, other embodiments than the ones disclosed above are equally possible within the scope of the invention, as defined by the appended patent claims.

As an example, the package in the embodiment of FIG. 1 and/or FIGS. 3*a*-3*c* may comprise a protective element in accordance with the embodiment of FIG. 2, and/or a hollow body in accordance with the embodiments of FIG. 4, 5, 10, 12, or any combination thereof.

As another example, the hollow body in the embodiment of FIGS. 4 and/or 5, may comprise a cutting member in accordance with the embodiment of FIGS. 9*a*-9*c* and/or FIG. 12.

As another example, the container in the embodiment of FIGS. 1 and/or 3*a*-3*c* may comprise a weakened portion in accordance with the embodiments of FIG. 6, 7, and FIGS. 11*a*-11*d*, or any combination thereof.

LIST OF REFERENCE SIGNS

100 Package
102 Container
104 Hollow body
106 First part
108 Second part
109 Third part
110 First section
112 Second section
114 Intersection point
116 Attachment portion
202 Container
208 Second part
212 Second section
218 Protective element
304 Hollow body
308 Second part
312 Second section
320 Flexible portion
420 Flexible portion
422 First piece
424 Second piece
426 Spacing element
427 Fluid outlet
428 Crimped portion
430 Cutting member
522 First piece
524 Second piece
526 Spacing element
632 Outer coating
634 Paper board layer
636 Lamination
638 Aluminum layer
640 First internal coating
642 Second internal coating
644 Weakened portion
744 Weakened portion
844 Weakened portion
846 Reel
920 Flexible portion
948 Upper part
950 Cutting part
1022 First piece
1024 Second piece
1026 Spacing element
1030 Cutting member
1230 Cutting member
1252 Ridge

The invention claimed is:

1. A package for a liquid food product, said package comprising:

a container, said container comprising a first section and a second section, wherein the first section comprises a first wall of the container and the second section comprises a second wall of the container, the first wall being adjacent to the second wall; and a hollow body for transporting said liquid food product from said container, wherein said hollow body comprises a first part fixedly attached to the first section of said container and a second part releasably attached to the second section of said container, the hollow body further comprising a first piece and a second piece, wherein a portion of a periphery of the first piece is attached to a portion of a periphery of the second piece, the first piece and second piece defining a flow channel therebetween, said flow channel extending between a first end of the first part and a second end of the second part and configured to provide a flow path for fluid flowing from an interior of the container through the first end of the first part and the second end of the second part;

wherein, when said second part is released from said second section of said container, said second part is pivotable around one axis of rotation in an intersection point between said first part and said second part and said second part is restricted to move in a pre-determined plane;

wherein the first piece of the hollow body comprises a flat surface configured to fixedly attach the first part of the hollow body to an external surface of the first wall of the container and releasably attach the second part of the hollow body to an external surface of the second wall of the container; and wherein the second piece of the hollow body comprises a cross-section configured to form said flow channel and further configured to restrict movement of the second part relative to the first part about the intersection point in the pre-determined plane.

2. The package according to claim 1, wherein said hollow body further comprises a third part arranged between said first part and said second part.

3. The package according to claim 2, wherein said third part is crimped.

4. The package according to claim 1, wherein said second wall is a top wall of said container.

5. The package according to claim 1, wherein at least one of said first piece and said second piece comprises at least one spacing element configured to keep said flow channel open.

6. The package according to claim 5, wherein the at least one spacing element comprises a triangular shape.

7. The package according to claim 5, wherein the at least one spacing element comprises a first spacing element extending from the first piece and a second spacing element extending from the second piece.

8. The package according to claim 7, wherein first and second spacing elements are located along the second part of the hollow body.

9. The package according to claim 5, wherein the at least one spacing element comprises a first spacing element positioned along the first part of the hollow body and a second spacing element positioned along the second part of the hollow body.

10. The package according to claim 9, wherein the first spacing element comprises a first length and the second spacing element comprises a second length, and wherein the first length is greater than the second length.

11. The package according to claim 9, wherein the first and second spacing elements extend from the first piece of the hollow body.

12. The package according to claim 1, wherein said first piece comprises a first material, said first material comprising a polymeric material.

13. The package according to claim 12, wherein said first material of said first piece comprises a thermoplastic selected from the group consisting of PET, PE, PP, and PS.

14. The package according to claim 1, wherein said second piece comprises a second material, said second material comprising a polymeric material.

15. The package according to claim 14, wherein said second material of said second piece comprises a thermoplastic selected from the group consisting of PET, PE, PP, and PS.

16. The package according to claim 1, wherein said second part is at least partially covered by a protective element such that an end section of said second part is prevented from being contaminated.

17. The package according to claim 16, wherein said protective element is attached to said container.

18. The package according to claim 16, wherein the protective element is perforated.

19. The package according to claim 1, wherein the first end of the first part of the hollow body is positioned proximate to a weakened portion of the container.

20. The package according to claim 1, wherein the first piece of the hollow body is stiffer than the second piece of the hollow body.

* * * * *